US008196898B1

(12) United States Patent
Huang

(10) Patent No.: US 8,196,898 B1
(45) Date of Patent: Jun. 12, 2012

(54) WATER-STOP PLUG OF FLUSH VALVE

(76) Inventor: Somei Huang, Tai Ping (TW)

( * ) Notice: Subject to any disclaimer, the term of this patent is extended or adjusted under 35 U.S.C. 154(b) by 0 days.

(21) Appl. No.: 12/929,853

(22) Filed: Feb. 22, 2011

(51) Int. Cl.
*F16K 1/16* (2006.01)

(52) U.S. Cl. ..... 251/298; 4/393; 4/378

(58) Field of Classification Search ..... 251/82, 251/366, 367, 294, 228, 299, 298; 4/331, 4/323, 378, 324, 393, 392, 400, 398, 397, 4/403

See application file for complete search history.

(56) References Cited

U.S. PATENT DOCUMENTS

| | | | | | |
|---|---|---|---|---|---|
| 1,919,700 | A * | 7/1933 | Lundberg | 4/330 |
| 3,955,218 | A * | 5/1976 | Ramsey | 4/324 |
| 4,002,521 | A * | 1/1977 | Schoepe et al. | 156/293 |
| 4,175,296 | A * | 11/1979 | Goldman | 4/325 |
| 4,293,964 | A * | 10/1981 | Riedel | 4/378 |
| 4,365,364 | A * | 12/1982 | Riedel | 4/378 |
| 4,536,900 | A * | 8/1985 | Hayes | 4/324 |
| 4,872,473 | A * | 10/1989 | Agostino | 137/270 |
| 5,129,110 | A * | 7/1992 | Richter | 4/324 |
| 5,153,948 | A * | 10/1992 | Smith et al. | 4/415 |
| 5,173,971 | A * | 12/1992 | Schoepe et al. | 4/378 |
| 5,195,189 | A * | 3/1993 | Gibb | 4/325 |
| 5,293,650 | A * | 3/1994 | Schoepe et al. | 4/378 |
| 5,692,249 | A * | 12/1997 | Johnson | 4/378 |
| 6,173,457 | B1 * | 1/2001 | Higgins | 4/393 |
| 6,336,229 | B1 * | 1/2002 | Guo | 4/325 |
| 7,216,373 | B2 * | 5/2007 | Huang | 4/393 |
| 7,222,375 | B2 * | 5/2007 | Chen et al. | 4/404 |
| 7,281,279 | B2 * | 10/2007 | Shieh | 4/403 |
| 7,937,782 | B2 * | 5/2011 | Vosler | 4/324 |
| 8,104,103 | B2 * | 1/2012 | Han | 4/393 |
| 8,122,526 | B2 * | 2/2012 | Li | 4/404 |
| 2006/0195977 | A1 * | 9/2006 | Shieh | 4/393 |
| 2006/0218713 | A1 * | 10/2006 | Chen et al. | 4/393 |
| 2008/0047052 | A1 * | 2/2008 | Han | 4/324 |
| 2010/0050331 | A1 * | 3/2010 | Sim | 4/324 |
| 2010/0212080 | A1 * | 8/2010 | Huang | 4/393 |

* cited by examiner

*Primary Examiner* — John Fristoe, Jr.
*Assistant Examiner* — Andrew J Rost
(74) *Attorney, Agent, or Firm* — Guice Patents PLLC

(57) ABSTRACT

The present invention relates to a water-stop plug of the flush valve including a connecting sheet, a fixing component and a casing body. The connecting sheet includes a ring part and a pair of hook-hanging parts, and users are capable of choosing the ring part or the pair of hook-hanging parts to fix the water-stop plug to the overflow tube according to the original overflow tube structure, and thereby being able to replace different types of water-stop plugs of flush valves.

3 Claims, 8 Drawing Sheets

WATER-STOP PLUG OF FLUSH VALVE

BACKGROUND OF THE INVENTION

1. Field of the Invention

The present invention relates to a water-stop plug of flush valve; and more particularly to a water-stop plug of flush valve capable of replacing different types of water-stop plugs of flush valves.

2. Brief Description of the Related Art

Existing flush valve for toilet cistern, such as flush valve 11, fits with a water-stop plug 13 at its outlet 111, as illustrated in FIG. 1. By pulling a chain 14, it is able to control the water-stop plug 13 to cover or expose the flush valve outlet 111 and thereby achieving the object of toilet flushing. However, owing to the long-term water pressure absorption, the water-stop plug 13 often deforms with time and therefrom no longer capable of covering the outlet 111; hence, the water-stop plug 13 requires regular replacement to prevent leakage.

For the foregoing reason, the regular replacement of water-stop plug 13 is a necessary repairing process. However, the existing model of water-stop plug 13 is mostly one of the following two types:

Hook-hanging type: as illustrated in FIG. 1, wherein a pair of hook-hanging parts 131 is disposed at the end of the water-stop plug 13; the hook-hanging parts 131 are used for hanging a pair of hooks 121 disposed at the bottom of an overflow tube 12.

Ring type: as illustrated in FIG. 2, wherein a ring part 22 is disposed at the end of the water-stop plug 2, and the ring part 22 slips over the overflow tube 12 to fix the water-stop plug 2 thereon.

The above-described models comprise the same problem as below:

The users don't usually pay attention to the model of their water-stop plugs; therefore, they often buy the wrong type of water-stop plugs and only find out when they try to replace them. Moreover, as for the hook-hanging type of water-stop plug 13, even the user has bought the correct type, there is still difference between various brands; the interval between the two hooks 121 varies from brands to brands. And since the two hooks 121 are made of hard material, when the replacing water-stop plug 13 has a different hook interval, it is very likely that the water-stop plug 13 will fail to cover the outlet 111 completely.

SUMMARY OF THE INVENTION

In order to overcome the deficiencies of the prior art, a primary object of the present invention is to provide a water-stop plug of flush valve capable of replacing different types of water-stop plugs of flush valves.

With the above object in mind, the present invention provides a water-stop plug comprising a connecting sheet, a fixing component and a casing body. The connecting sheet comprises a ring part and a pair of hook-hanging parts, and the user is capable of choosing the ring part or the pair of hook-hanging parts to fix the water-stop plus to the overflow tube according to the original overflow tube structure.

The connecting sheet of the present invention includes the two structures of prior art: ring type and hook-hanging type to fit with all kinds of toilet cistern interior designs. Further, the present invention connects a portion where the overflow tube is attached to a gasket disposed at the bottom of exiting fixing component to a connecting sheet that is of a whole form, and disposes a flange surrounding a through hole provided thereof, tabling with a ring-shaped groove of the fixing component. This way, the connecting sheet is prevented from detaching when the water-stop plug opens or closes.

BRIEF DESCRIPTION OF THE INVENTION

The detail structure, the applied principle, the function and the effectiveness of the present invention can be more fully understood with reference to the following description and accompanying drawings, in which.

DETAILED DESCRIPTION OF THE PREFERRED EMBODIMENTS

Figure 1:
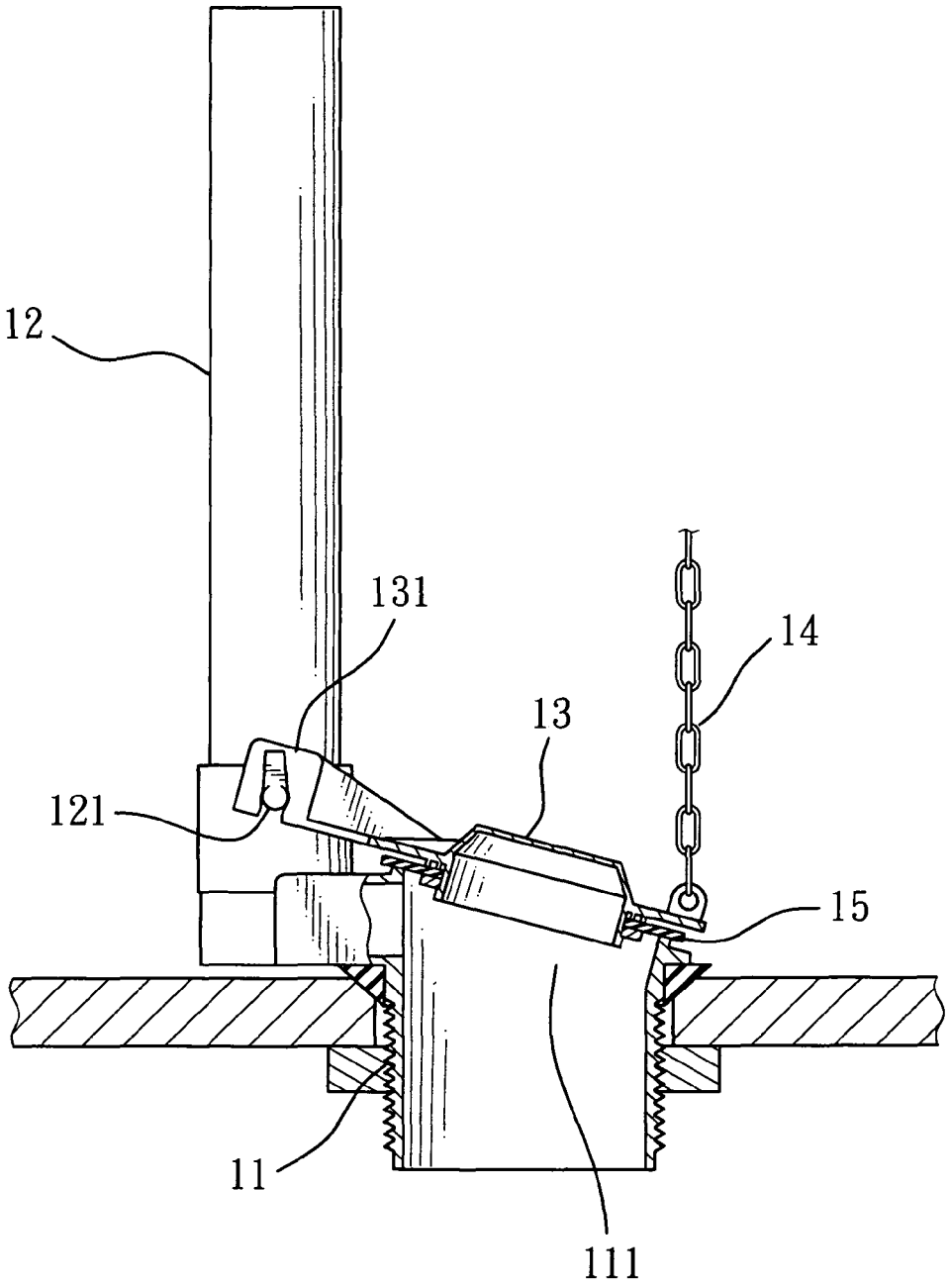
FIG. 1 PRIOR ART
FIG. 1 is a schematic representation of hook-hanging type water-stop plug according to prior art.
Figure 2:
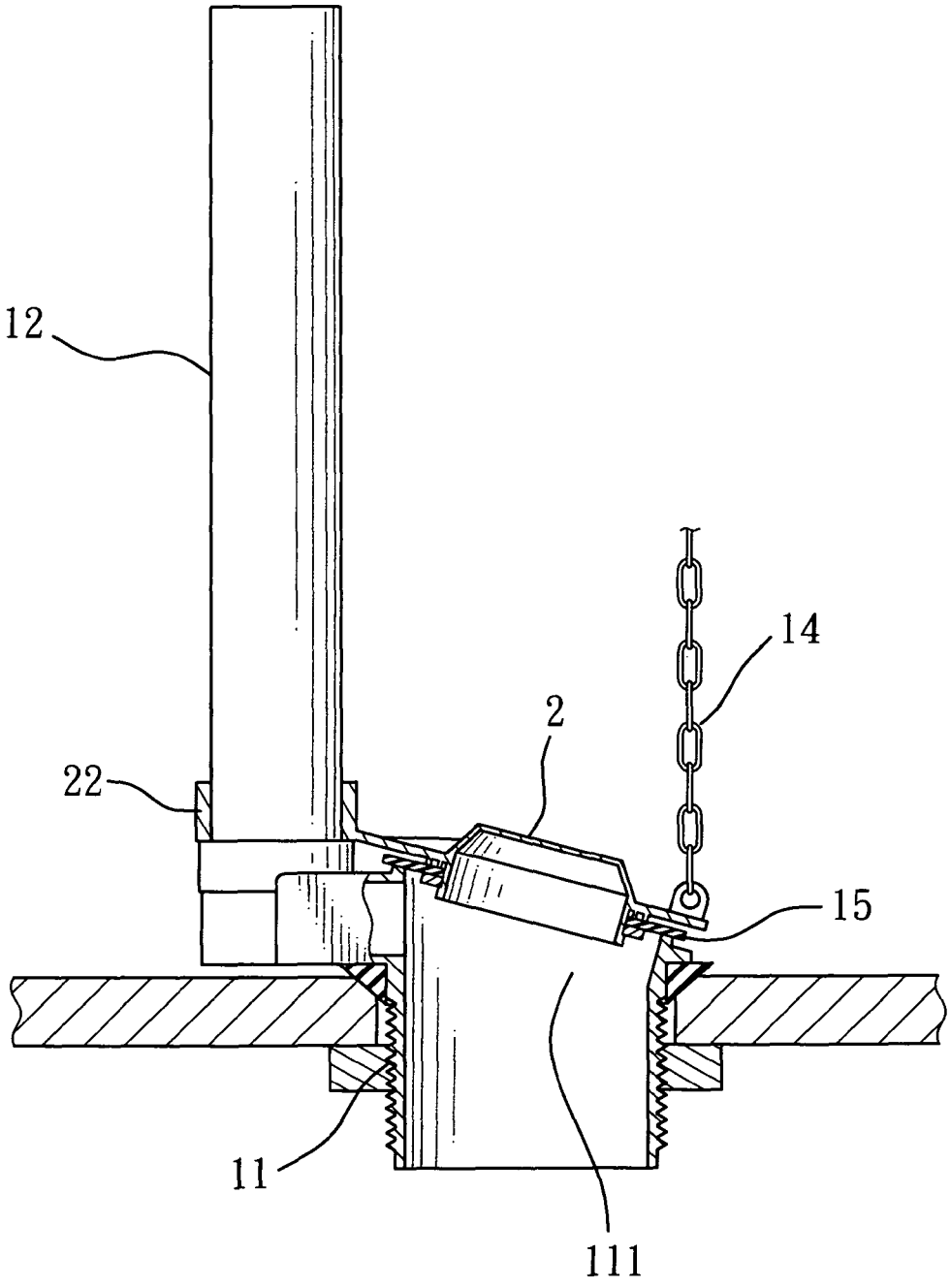
FIG. 2 PRIOR ART
FIG. 2 is a schematic representation of ring type water-stop plug according to prior art.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

Figure 3:
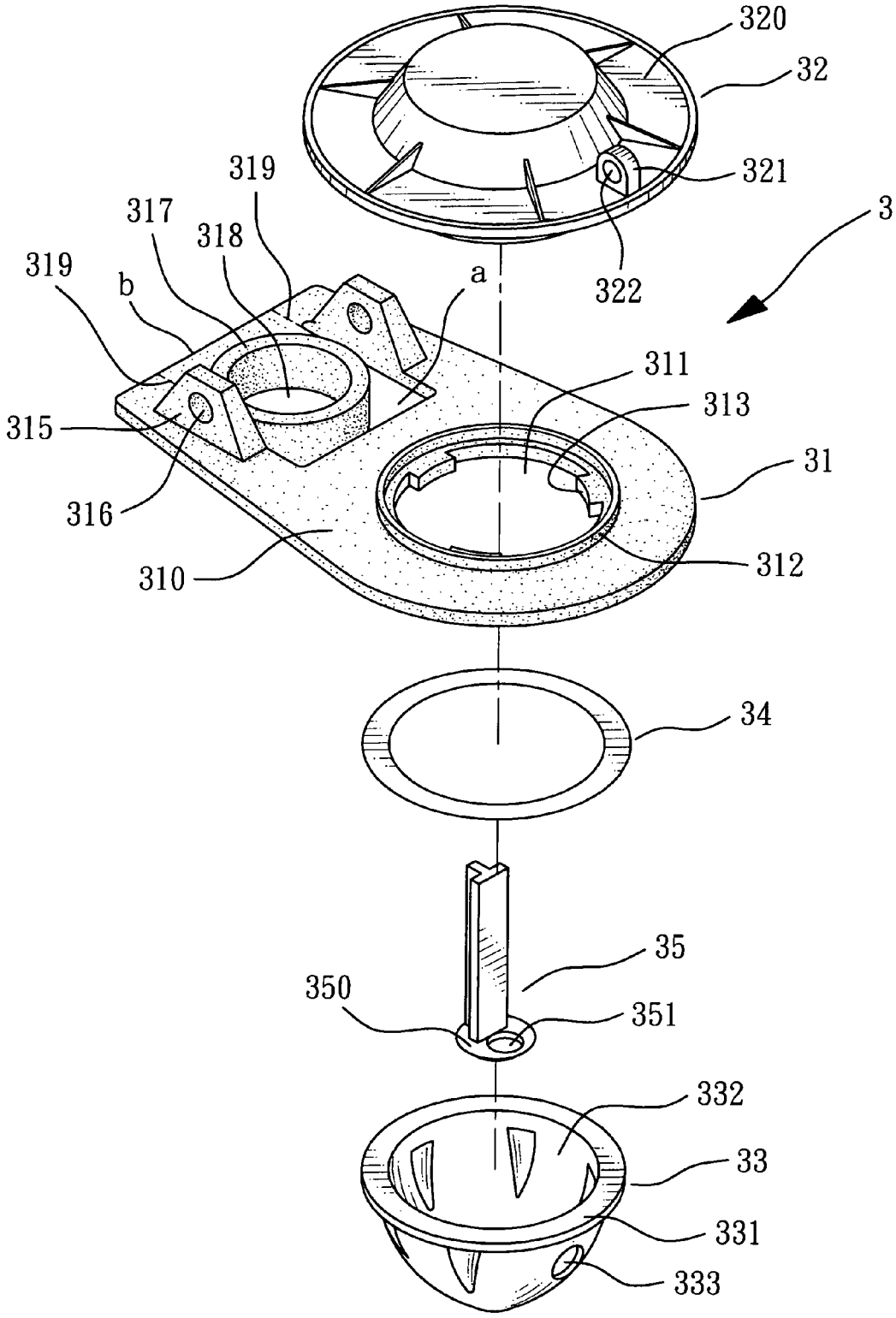
FIG. 3 is an exploded perspective view according to the present invention.
Figure 4:
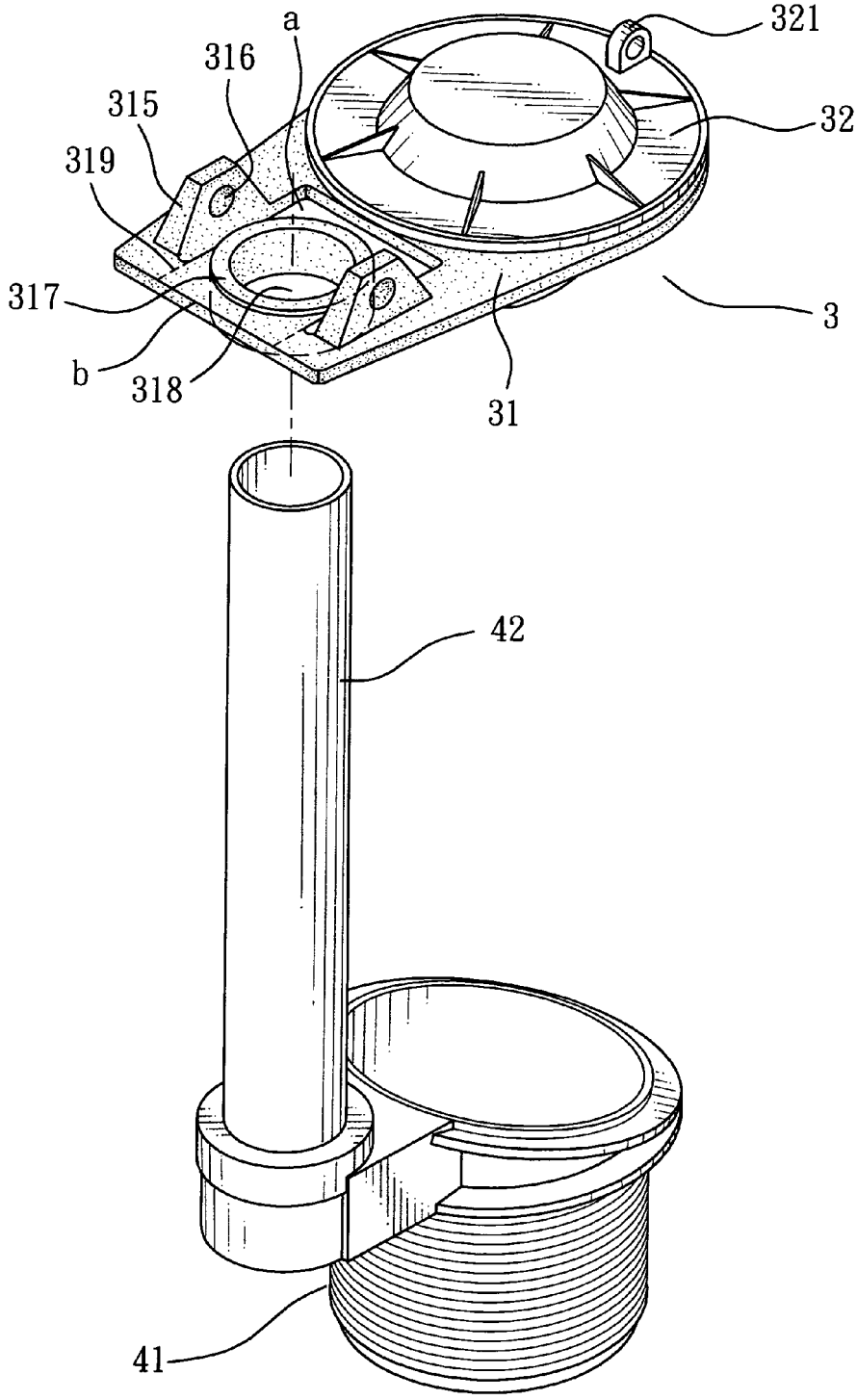
FIG. 4 is a perspective view of an embodiment according to the present invention.

With reference to FIGS. 3 and 4, the present invention provides a water-stop plug 3 of flush valve, comprising: a connecting sheet 31, a fixing component 32 and a casing body 33. The fixing component 32 fits with the top surface of the connecting sheet 31, and the casing body 33 fits with the bottom surface of the connecting sheet 31.

The connecting sheet 31 is a sheet body 310 made of soft material, wherein the sheet body 310 is disposed of a through hole 311 at one side, and a flange 312 and at least one position-limiting protrusion 313 are disposed around the peripheral edge of the through hole 311. A ring part 317 is disposed at the other side of the sheet body 310, wherein two hook-hanging parts 315 are correspondingly disposed at two sides of the ring part 317 respectively, and a U-shaped through hole a is disposed between the two hook-hanging parts 315 and the ring part 317. Two cutting lines 319 are marked along the U-shaped through hole a on a lateral edge b of the sheet body 310. The two hook-hanging parts 315 each has a hanging hole 316, and the ring part 317 has a fitting hole 318.

Figure 5:
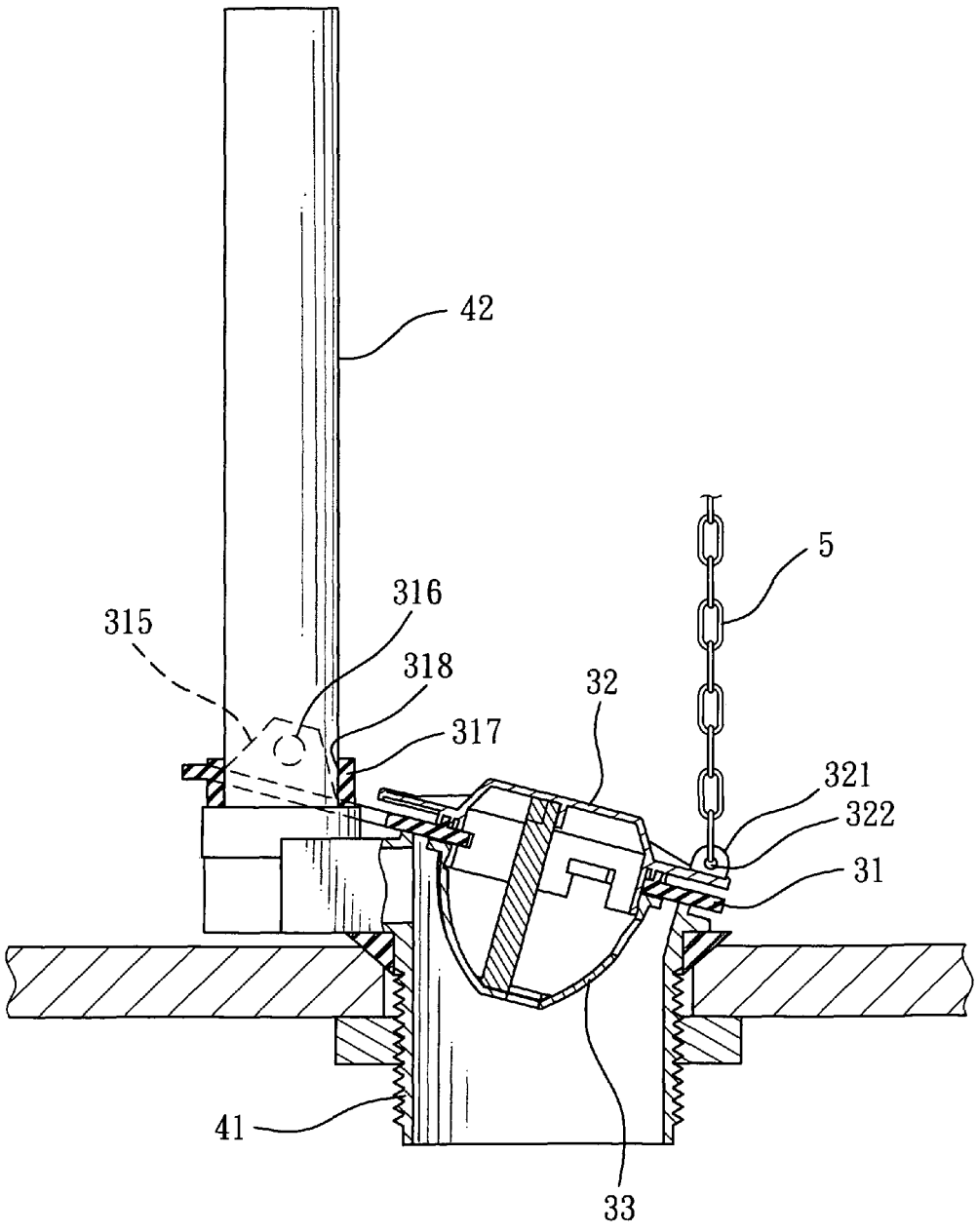
FIG. 5 illustrates first sectional view of an embodiment according to the present invention.
Figure 6:
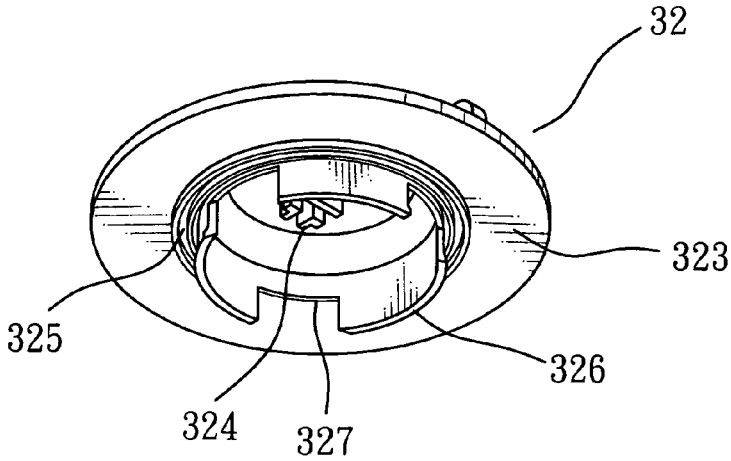
FIG. 6 is a perspective view of the fixing component according to the present invention.
Figure 7:
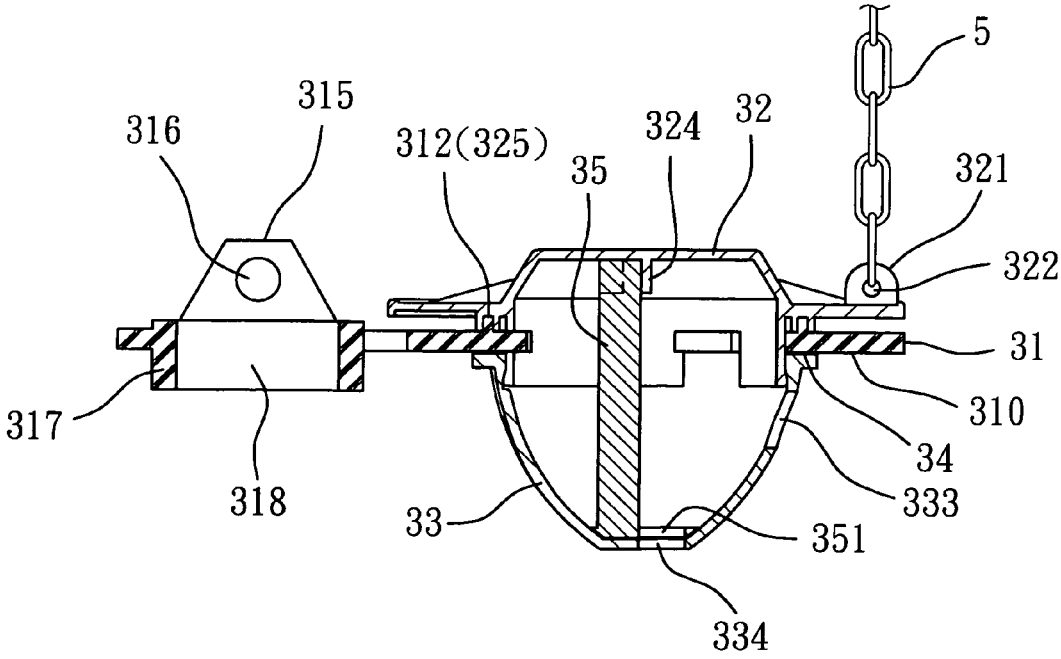
FIG. 7 illustrates second sectional view of an embodiment according to the present invention.

Referring to FIGS. 5-7, wherein the fixing component 32 provides a hanging seat 321 on the surface 320 thereof, and the hanging seat 321 has a through hole 322 to allow hanging of a chain 5. Bottom surface 323 of the fixing component 32 has a connecting base 324 at the center thereon to allow insertion of a fixing rod 35; the end of the fixing rod 35 is a disk 350 having a through hole 351, and a ring-shaped groove 325 and a plurality if position-limiting sheets 326 are disposed on the bottom surface 323 corresponding to the through hole 311. A notch 327 is disposed between every two adjacent position-limiting sheets 326, wherein the notch 327 is corresponding to the position-limiting protrusion 313 of the connecting sheet 31 to allow the insertion of the position-limiting protrusion 313 thereof. The ring-shaped groove 325 is provided to allow insertion of the flange 312 of the connecting sheet 31 and thereby limiting the position of the connecting sheet 31.

The casing body 33 is a hemisphere fitting with the bottom surface of the connecting sheet 31 and tabling with the position-limiting sheets 326 of the fixing component 32. The casing body 33 comprises a concave receiving chamber 332, a first air hole 333, and a second air hole 334; a flange 331 is disposed around the peripheral edge thereof.

A slip gasket 34 is disposed between the connecting sheet 31 and the casing body 33 and is capable of reducing the frictional resistance caused by the casing body 33 rotating to adjust the entrance and exit amount of air.

With reference to FIGS. 4 and 5, when the overflow tube 42 is not disposed with hanging hooks, the user is able to replace the water-stop plug by fitting the overflow tube 42 with the fitting hole 318 on the ring part 317 of the connecting sheet 31.

Figure 8:
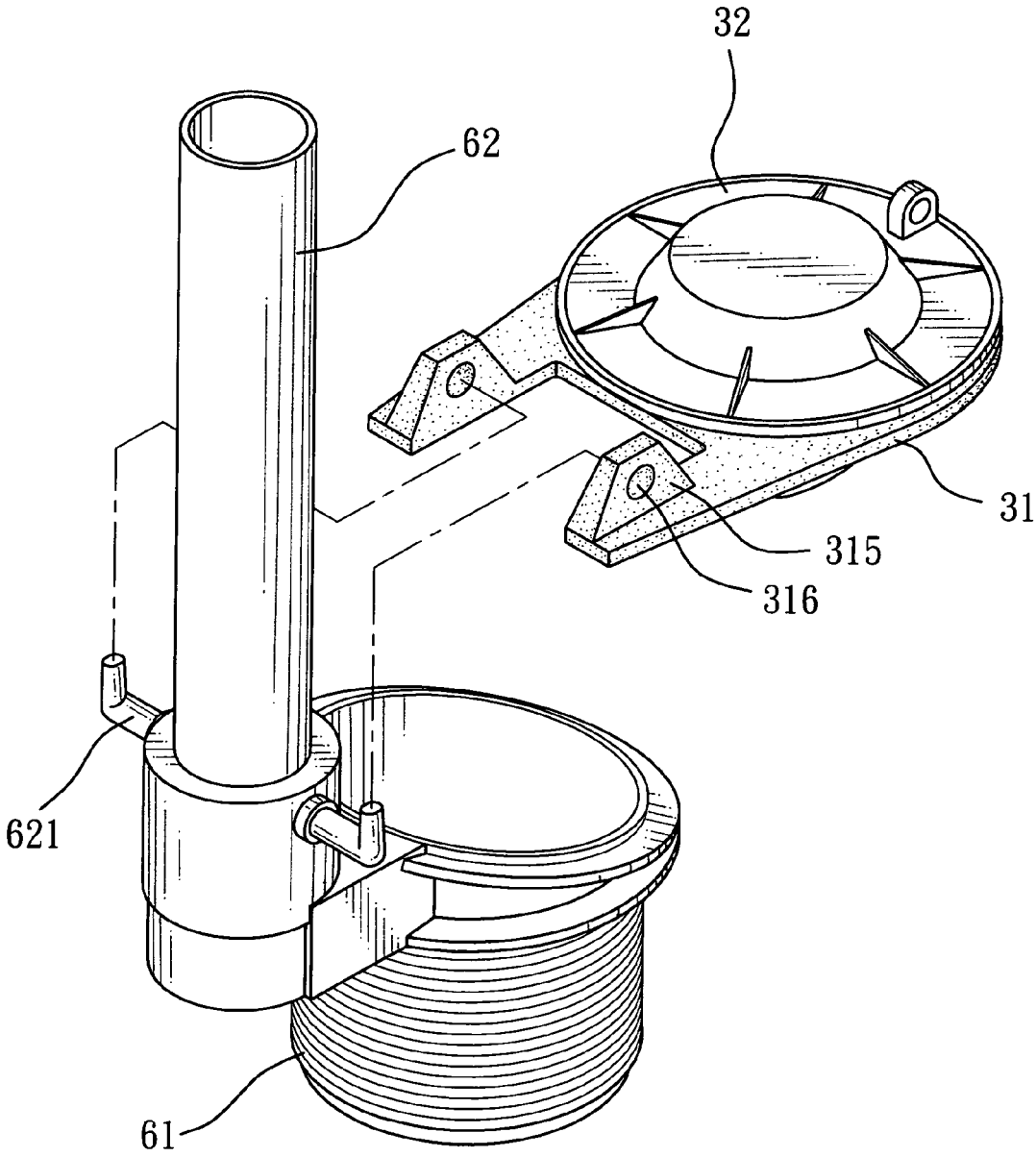
FIG. 8 is a perspective view of the second embodiment according to the present invention.
Figure 9:
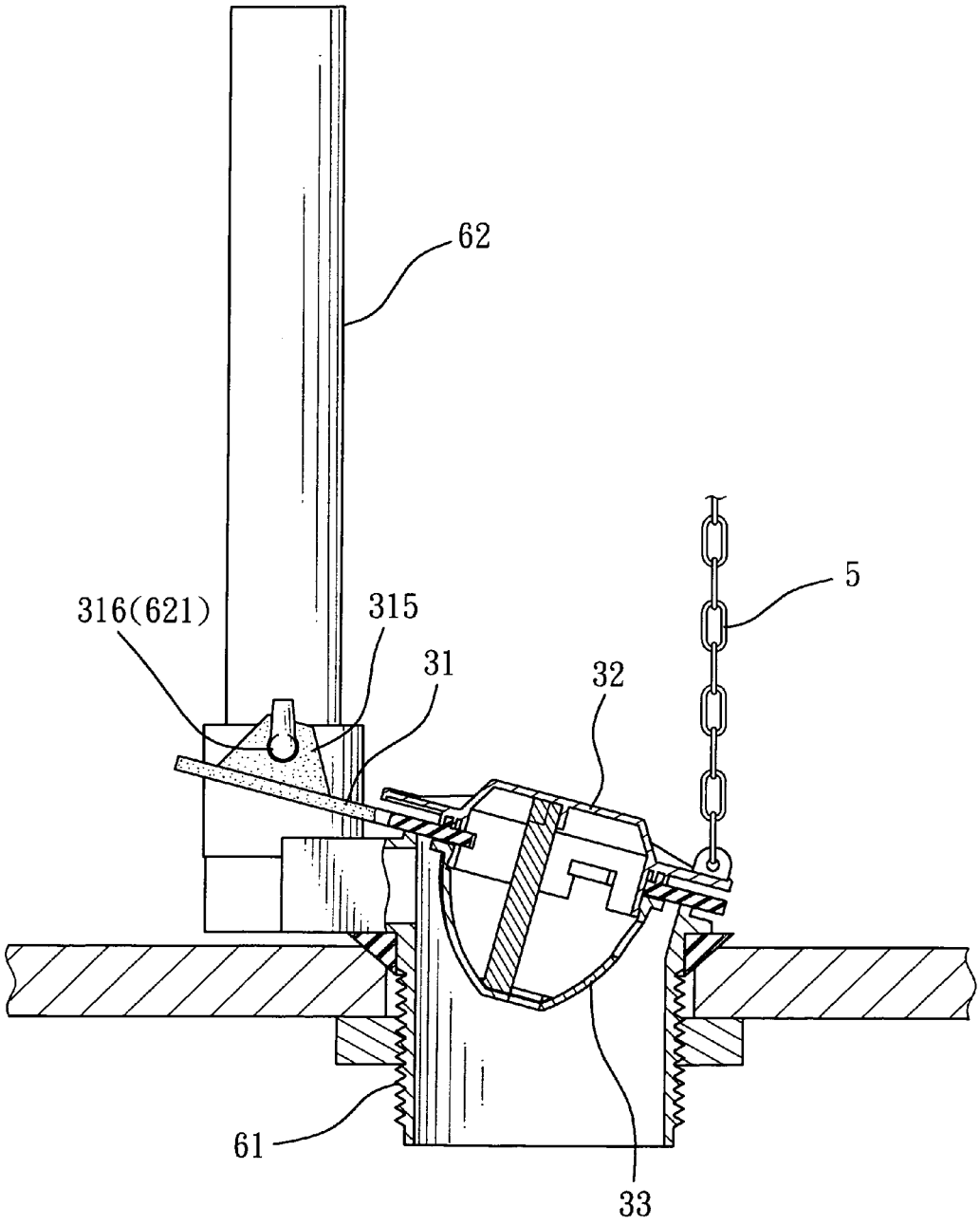
FIG. 9 is a sectional view of the second embodiment according to the present invention.

Please further refer to FIGS. 8 and 9, wherein the water-stop plug of the flush valve 61 requires replacement. When the overflow tube 62 is disposed of hooks 621, cut along the cutting lines 319 with scissors and therefrom removing the ring part 317; then hang the hooks 621 onto the hook-hanging parts 315 through the hanging hole 316 thereon to complete the replacement. Moreover, since the connecting sheet 31 is made of soft material, the interval between the two hooks 621 maybe adjusted slightly.

While the invention has been described with reference to a preferred embodiment thereof, it is to be understood that modifications or variations may be easily made without departing from the spirit of this invention, which is defined in the appended claims.

I claim:

1. A water-stop plug of the flush valve comprising a connecting sheet, a fixing component and a casing body; the fixing component fits with the top surface of the connecting sheet, and the casing body fits with the bottom surface of the connecting sheet; wherein:

the connecting sheet is a sheet body made of soft material, wherein the sheet body is disposed of a through hole at one side, and a flange and at least one position-limiting protrusion are disposed around the peripheral edge of the through hole; a ring part is disposed at the other side of the sheet body, wherein two hook-hanging parts are correspondingly disposed at two sides of the ring part respectively, and a U-shaped through hole is disposed between the two hook-hanging parts and the ring part; the two hook-hanging parts each has a hanging hole, and the ring part has a fitting hole;

the fixing component provides a hanging seat on the surface thereof, and the hanging seat has a through hole to allow hanging of a chain; a ring-shaped groove and a plurality of position-limiting sheets are disposed on the bottom surface of the fixing component corresponding to the through hole; a notch is disposed between every two adjacent position-limiting sheets, wherein the notch is corresponding to the position-limiting protrusion of the connecting sheet to allow the insertion of the position-limiting protrusion thereof; the ring-shaped groove is provided to allow insertion of the flange of the connecting sheet and thereby limiting the position of the connecting sheet; and the casing body is a hemisphere fitting with the bottom surface of the connecting sheet and tabling with the position-limiting sheets of the fixing component; wherein the casing body comprises a concave receiving chamber and a flange is disposed around the peripheral edge thereof.

2. The water-stop plug of the flush valve as defined in claim 1, wherein a slip gasket disposed between the connecting sheet and the casing body.

3. The water-stop plug of the flush valve as defined in claim 1, wherein two cutting lines are marked along the U-shaped through hole on a lateral edge of the sheet body.

* * * * *